United States Patent [19]

Callaway et al.

[11] 4,087,874

[45] May 9, 1978

[54] INFANT CARRIER BAG WITH MOVABLE FILLER BENEATH PILLOW

[76] Inventors: Lee Weller Callaway; Michael Arthur Callaway, both of 1746 View Dr., Milpitas, Calif. 95035

[21] Appl. No.: 770,088

[22] Filed: Feb. 18, 1977

[51] Int. Cl.[2] ..... B32B 3/20; A47G 9/00

[52] U.S. Cl. ..... 5/343; 2/69.5; 5/344

[58] Field of Search ..... 5/93, 94, 335, 343, 5/355; 2/69.5

[56] References Cited

U.S. PATENT DOCUMENTS

| | | | |
|---|---|---|---|
| 3,178,734 | 4/1965 | Carrey | 5/343 |
| 3,579,675 | 5/1971 | Scheer | 5/343 |
| 3,900,648 | 8/1975 | Smith | 5/355 |
| 3,965,504 | 6/1976 | Ainsworth | 5/335 |

*Primary Examiner*—Casmir A. Nunberg
*Attorney, Agent, or Firm*—Thomas Schneck, Jr.

[57] ABSTRACT

A carrier bag for infants wherein a two-layer inner bag is provided with a lower support layer section and an upper pillow layer section. The inner bag is removably disposed within an outer bag having a quilt attached thereto so that an infant may be placed on top of the outer bag and covered with the quilt.

3 Claims, 8 Drawing Figures

INFANT CARRIER BAG WITH MOVABLE FILLER BENEATH PILLOW

BACKGROUND OF THE INVENTION

1. Field of the Invention

The invention relates to blankets and coverings for infants, and more particularly, to an infant carrying or sleeping bag.

2. Prior Art

Infant sleeping bags and carrier bags with removable inner portions are known. For example, U.S. Pat. No. 2,491,394 to Rose and U.S. Pat. No. 2,358,410 to Matthesius exemplify two such bags.

While prior art bags suited their intended uses, such uses were somewhat limited. For example, prior art bags were usually intended to be used either as carrier bags or sleeping bags, or perhaps both.

It is my object to provide an infant carrier bag which provides for more uses than prior art bags, yet which is easy to clean and attractive in appearance.

SUMMARY OF THE INVENTION

The above object is achieved by providing an infant carrier bag made of an inner bag disposed within an outer bag which serves as a lining for the inner bag. The inner bag has a lower support section containing a movable filler. This support section extends the length of the bag beyond the head-to-toe length of the infant to be carried. Above the lower support section is a pillow section at the head region of the bag. The movable filler may be used to augment the pillow section.

The outer bag has a quilt attached above the outer bag to provide a covering for an infant resting on the outer bag. The quilt is attached at the toe region of the bag and extends up to the pillow region. In one embodiment, the outer bag is provided with a closeable slit for removing the inner bag for the purpose of washing or cleaning both bags.

DESCRIPTION OF THE PREFERRED EMBODIMENT

Figure 1:
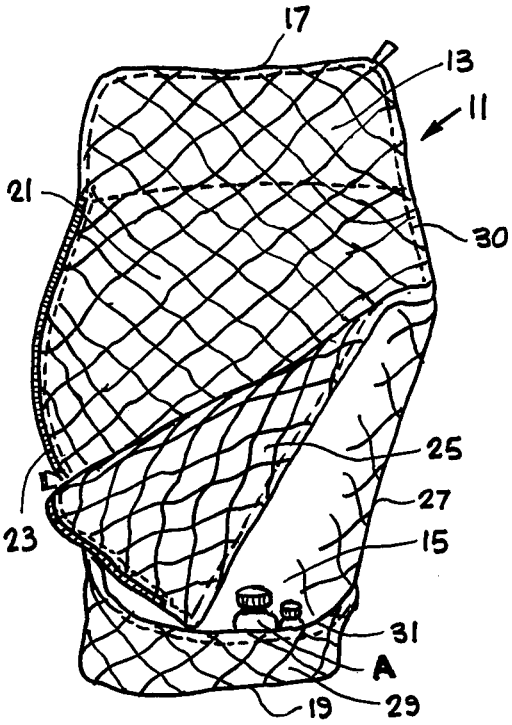
FIG. 1 is a perspective view of an infant carrier bag of the present invention.

With reference to FIG. 1, an infant carrier bag 11 is shown to have a head region 13 and a toe region 15, which respectively approximate the head and toe positions of an infant to be carried within bag 11. The bag has a narrow region at its top 17, approximately 13 inches from edge to edge and a narrow region at its bottom 19 which is also approximately 13 inches from edge to edge. From top to bottom the bag is approximately 30 inches long and has a wide portion 21 which is approximately 19 inches in width from edge to edge. The distance from the region of maximum width 21 to the top of the bag 17 is approximately 9 inches. All of these dimensions are exemplary and are not required for critical dimensions.

It will be noted that a zipper 23 is provided along the left edge of the bag so that the first quilt 25 may be closed with respect to the bag. Quilt 25 is sewn to the bag at the bottom 19 of the bag at the distal end of toe region 15. It is also sewn to the bag along the first edge 27. The dashed line 29 indicates an inner bag beneath the outer bag which is visible in FIG. 1. A second quilt 29, forming a strip of quilting is disposed across the bottom of the toe region 15 of the bag and sewn at the bottom 19 thereof, as well as the opposed sides thereof. An elastic band 31 is provided at the top of the quilting strip 29 so that articles A may be held therein.

Figure 2:
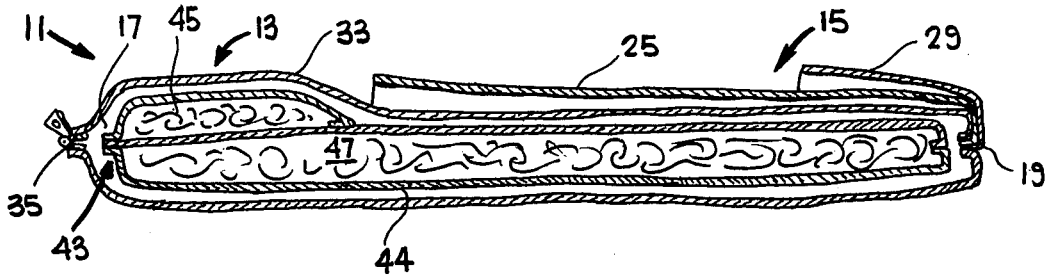
FIG. 2 is a side sectional view of the carrier bag of FIG. 1.

With reference to FIG. 2, the second quilt 29 may be seen as the uppermost member of bag 11. The first quilt 25 is seen to be disposed below it, extending from the bottom of the bag to an end of the pillow section 13. Below the quilt blanket 25 is an outer bag 33 which completely surrounds materials therein. The outer bag is made of a durable machine-washable fabric, such as muslin. At the top of the outer bag a slit 35 is provided for giving access to the interior thereof. Outer bag 33 is formed of two sections, one forming the upper portion of the bag and one forming a lower portion, both being sewn together at the bottom 19 of the bag. The opening 35 at the top of the bag is provided with a closure such as a Velcro strip. Velcro is a trademark for a nylon tear snap fastener.

Inside of the outer bag 33, an inner bag 43 is provided. Inner bag 43 has a lower support section 44 extending the length of the bag from the bottom 19 to the top 17, beyond the head to toe length of an infant to be carried therein. Lower support section 44 contains a movable filler, such as shredded polyurethane foam. The filler is moved merely by picking up the bag and shaking it, allowing the foam to fall in the desired direction.

In elevation, above the lower support section 44 is disposed a pillow section 45, attached to the lower support section, as by sewing. Pillow section 45 also has filler material disposed therein, but this filler material does not communicate with the filler material of the lower support section 43. Rather, it is enclosed within the pillow section 45 and always remains there. Thus, the depth of the pillow section 45 may be increased by adding filler material beneath it from within the lower support section 43. Both the pillow section 45 and the lower support section 44 are made of a durable muslin fabric. In FIG. 2, a uniform distribution of filler material 47 is illustrated.

Figure 3:
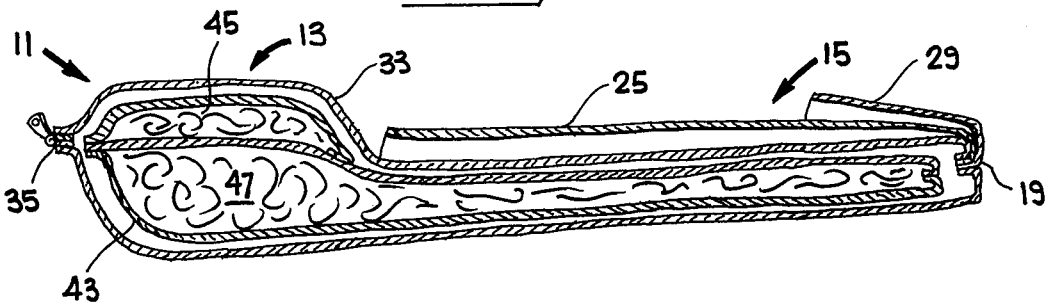
FIG. 3 shows the infant carrier bag of FIG. 2 with filler material moved to a position beneath the pillow section.

In FIG. 3, it is seen that the filler material 47 has been moved, as by shaking, so that a substantial portion of it is in the head region 13 below pillow section 45. Alternatively, the filler material could have been moved, as by shaking, to the toe region 15 of the infant carrier bag 11. An alternate embodiment of the bag of the present invention is shown in FIG. 4.

Figure 4:
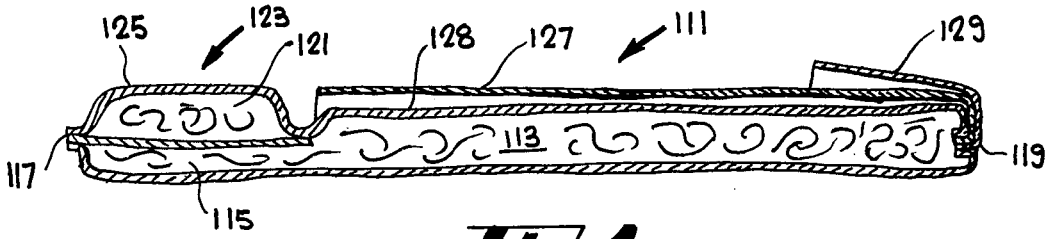
FIG. 4 is a side sectional view of an alternate embodiment of the infant carrier bag of the present invention.

With reference to FIG. 4, an infant sleeping bag 111 is shown having a bag section 113 containing a movable bag filler 115, such as polyurethane foam. The bag section 113 extends the entire length of the bag from top 117 to bottom 119. A closed pillow bag 121, which also contains bag filler, such as polyurethane foam, is disposed under the first bag section at the head region 123 thereof, beneath pillow shroud 125 which is an extension of the upper cover 128 of bag section 113. The first bag section 113 may be viewed as a type of mattress to be used by an infant with a built-in pillow 121. However, since movable filler 115 is used, the amount of bulk in the head region may be substantially increased.

A first quilt 127 is provided over the first bag section, similar to the manner that the quilt blanket 25 was connected to the lower support section of bag 11 in FIG. 1. Also, a second quilt strip 129 is attached to the first bag section 113 similar to the manner in which the quilt strip 29 was attached to the bottom 19 of bag 11 in FIG. 1. It will be noted that the various quilt and bag sections, except for the pillow section, have a common boundary at the bottom 119 of the bag where all may be sewn together in FIGS. 2–5. At the top of the bag, 117, the first bag 113 may be provided with an opening for adding or removing filler. However, the pillow 121 may alternatively be sewn in place or provided with an opening at the top region 117 for removal. The first bag section 113 is made of a fabric having a decorative exterior because the fabric will be seen beneath the quilt blanket 127. On the other hand, in FIG. 2, the inner bag 43 was made entirely of unbleached muslin, or the like, which is highly washable, while the outer bag was made of a decorative polyester cotton fabric. While the choice of materials is not critical, materials for easy washability should be selected.

Figure 6:
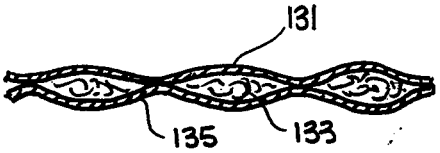
FIG. 6 is a side sectional view of material used in construction of the outer bag.
Figure 5:
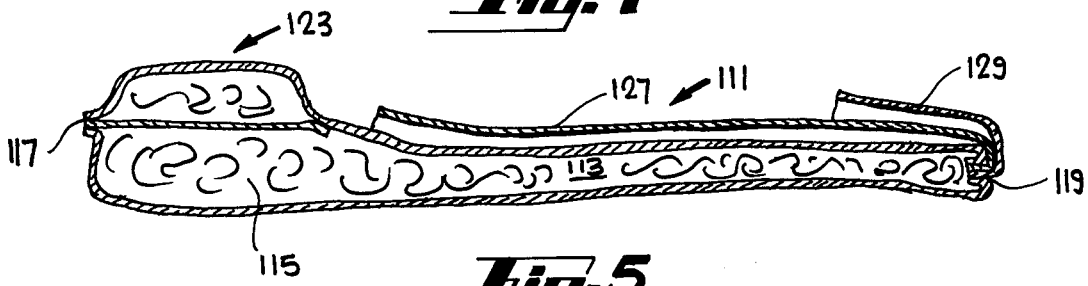
FIG. 5 shows the infant carrier bag of FIG. 4 with filler material moved to a position beneath the pillow bag.

FIG. 5 shows the bag of FIG. 6 wherein the filler material 115 has been moved, as by shaking, to a location beneath pillow region 123. Alternatively, the filler material 115 could have been moved to the opposite end of the bag if desired.

FIG. 6 shows in detail the structure of the decorative outer bag fabric which is used in FIG. 2 and the first bag section 113 of FIG. 4. The fabric has an upper layer 131 which is usually printed with an attractive design, an intermediate fluffy layer 133, which may be fluffed cotton or polyester, backed by a nylon tricot net backing material 135 which faces inwardly at all times. Such fabrics are ready-made and may be purchased commercially.

Figure 7:
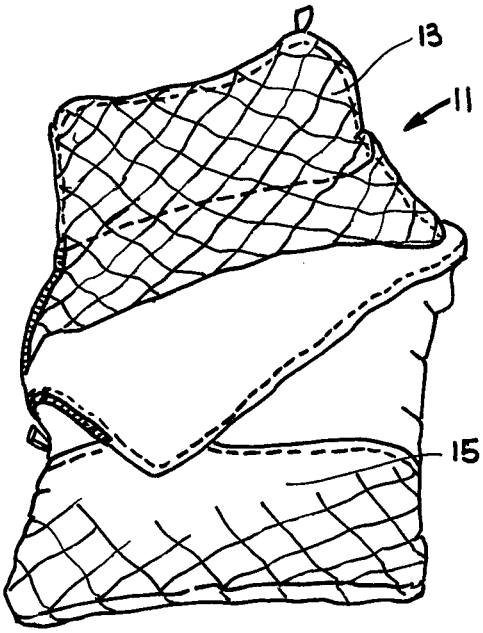
FIG. 7 is a perspective view of the infant carrier bag of FIG. 1 used as a pillow seat.

FIG. 7 illustrates use of the infant carrier bag of FIG. 1. In FIG. 7, filler material has been moved to the head region 13 from the toe region 15 so that an infant's head may be propped against a wall, a car seat or the like. In this position, an infant's head will have maximum benefit of the pillow. Because a separate pillow section has been provided, it is easy to fold the bag at the bottom of the pillow section.

Figure 8:
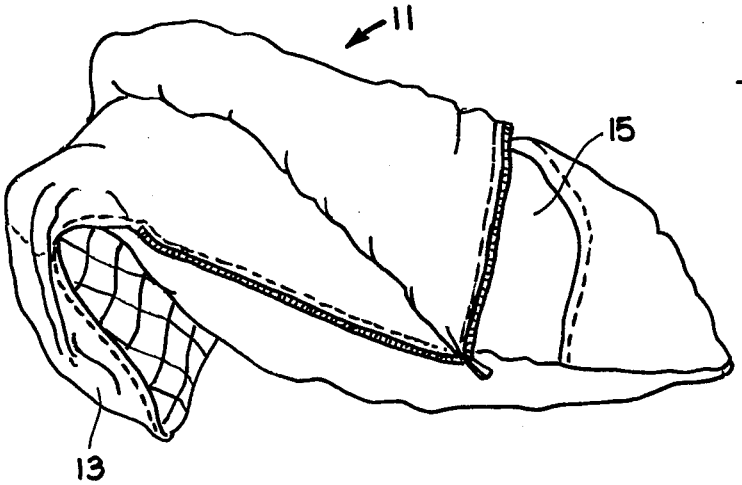
FIG. 8 is a perspective view of the infant carrier of FIG. 1 used as a carrier or sleeping bag.

With reference to FIG. 8, filler material has been moved toward the toe region 15 of bag 11 while the pillow region 13 has been folded beneath the central bag region. This position is desirable for carrying an infant or to provide support for a sitting position. Of course, the bag may also be used flat for sleeping or carrying. However, there are some locations, such as shopping carts and the like where it is desireable to use the bag configuration shown in FIG. 8.

In this patent application, the term "top" and "bottom" have been used in reference to head and tow regions of the sleeping bag while the terms "lower" and "upper" have been used to refer to construction elevations shown in FIGS. 2–5. Obviously, the terms are not used in any absolute sense, but merely a relative sense to indicate directions and positions.

What is claimed is:

1. An infant carrier bag comprising, a closed inner bag having a lower support section containing a movable filler extending in length beyond the head to toe length of an infant to be carried and a closed pillow section disposed in elevation above said lower support section at a head region thereof an outer bag completely lining the exterior of said inner bag and a first quilt attached to said outer bag above said outer bag opposite said head region, at a toe region so that an infant may be placed between said first quilt and said outer bag, said first quilt being connected to said outer bag along a first side thereof from a distal tip of said toe region toward said head region, said first quilt including a closure along a portion of a second side thereof, opposite said first side, opening said first quilt with respect to the outer bag, and a second quilt connected to said first quilt at said toe region and extending above a portion of said first quilt from said toe region a distance less than half the length of said first quilt in the direction of said head region, forming a quilt strip.

2. The infant carrier bag of claim 1 wherein said inner bag is removably disposed within said outer bag.

3. The infant carrier bag of claim 2 wherein said outer bag includes a closure extending across a dimension of said outer bag for allowing removal of said inner bag from said outer bag.

* * * * *